US005389763A

United States Patent [19]

Nagan et al.

[11] Patent Number: 5,389,763

[45] Date of Patent: Feb. 14, 1995

[54] CORE REMOVER

[75] Inventors: Dennis Nagan; Kevin Whitney, both of Green Bay, Wis.

[73] Assignee: Riverdale of Green, Inc., Green Bay, Wis.

[21] Appl. No.: 101,218

[22] Filed: Aug. 2, 1993

[51] Int. Cl.[6] ..... H05B 3/42

[52] U.S. Cl. ..... 219/221; 219/523; 219/242

[58] Field of Search ..... 219/221, 227, 229, 242, 219/523; 99/419; 156/584, 344

[56] References Cited

U.S. PATENT DOCUMENTS

| | | | |
|---|---|---|---|
| 1,902,564 | 3/1933 | Mabey . | |
| 2,045,466 | 6/1936 | Hellbach . | |
| 2,686,091 | 10/1954 | Young | 156/344 X |
| 3,473,005 | 10/1969 | Grandinetti | 219/242 X |
| 3,635,146 | 1/1972 | Aubert | 219/523 X |
| 3,906,612 | 9/1975 | Tupy | 219/229 X |
| 3,965,808 | 6/1976 | Chomette | 99/419 |
| 4,254,918 | 3/1981 | Huggins | 242/68.5 |
| 4,317,986 | 3/1982 | Sullivan | 156/584 |
| 4,461,663 | 7/1984 | Tachibana et al. | 156/584 X |
| 4,529,865 | 7/1985 | Oakes | 219/523 X |
| 4,549,923 | 10/1985 | Tachibana et al. | 156/584 X |
| 4,691,095 | 9/1987 | Barowski et al. | 219/242 X |
| 4,763,785 | 8/1988 | Bradley et al. | 206/389 |
| 4,889,598 | 12/1989 | Niskanen | 162/199 |
| 4,919,759 | 4/1990 | Ilmarinen | 162/206 |
| 5,100,075 | 3/1992 | Morand | 242/55.2 |

*Primary Examiner*—Teresa J. Walberg
*Attorney, Agent, or Firm*—Wheeler & Kromholz

[57] ABSTRACT

A core remover for removing cores from paper rolls comprising a two-piece heating conducting tube, the top part of the tube having, a smooth tapered tip, containing a thermostat bulb and a heating element for heating the tube, and the connection elements for the thermostat and heating element extending downward through the bottom part of the tube and to the thermostat. The thermostat and heating element are connected so that control of the temperature of the heating element and tube may be made. A core with paper wrapped around it is placed over the tube and heated for a few seconds to loosen the glue. Following that, the core is manually removed and at the same time or after, the inner most sheet of paper is pulled about 2 inches from the center of the paper roll.

9 Claims, 1 Drawing Sheet

CORE REMOVER

BACKGROUND OF THE INVENTION

The device of this invention is a core remover for removing the core from paper toweling and the like. It is becoming popular to sell paper toweling and toilet tissue in rolls from which the cardboard core has been removed so that the toweling or tissue can be withdrawn from the center of the roll rather than unwound from the outside. In order to do that it is necessary to remove the cardboard paper core from the toweling center. The normal roll of paper towel is made by gluing the original strip of paper to the cardboard core and rotating the core so as to wind the paper into a roll.

Since the paper is glued to the paper core and is tightly wound into a roll it is difficult to remove the core after the roll has been formed. The inventor has found by means of a unique and simple design that removal of the paper core may be quickly and efficiently effected. The inventor knows of no prior art which either teaches or shows the present invention.

For example, U.S. Pat. No. 5,100,075 (Morand) discloses a core remover but that structure is not heated. The Morand core remover also serves as a spindle on which the roll is mounted. There is no discussion of central dispensing.

U.S. Pat. Nos. 3,965,808 (Chomette) and 3,635,146 (Aubert) both deal with heating bread. Their only similarity to the present invention is the physical form of the heater similar to the core removal apparatus of the present invention. However, while the physical form of the device is similar they differ substantially from the present invention as claimed.

U.S. Pat. No. 4,763,785 (Bradley et al.) discusses a very different method of core removal involving a core which is wrapped in paper treated with a release agent. The object of this device is center dispensing. However, the structure of the present invention is not disclosed.

U.S. Pat. No. 4,919,759 (Ilmarinen et al.) discloses the use of heat but the invention of that particular patent discloses the heat being applied to a machinery roll rather than to a core on which paper is wound. The purpose of the structure is quite different, having to do with the behavior of paper in a printing press.

U.S. Pat. No. 4,889,598 (Niskanen) is similar to U.S. Pat. No. 4,919,759. U.S. Pat. No. 3,473,005 (Grandinette) is even less pertinent since it has to do with the heating of a hair roller.

SUMMARY OF THE INVENTION

The invention is a tube, made from metal or other material through which heat may be transferred, provided with a smooth tapered tip. The tube has two parts, a top part, with the smooth tapered tip, and a bottom part. The inside of the tube is occupied by a heating element and a temperature sensor. The tube is placed inside the opening of a core of a paper roll and the heating element is turned on so that the heating element heats the tube so that the cardboard core is heated to a temperature that softens the glue connecting the exterior surface of the core to the paper. The thermostat and the heating element are connected so that the temperature of the heating element may be monitored and adjusted with and by the thermostat.

Once the glue has been sufficiently softened the tube is removed from the cardboard core and the cardboard core is then removed from the roll of paper. The time required for softening is generally only a few seconds. Simultaneously, or immediately afterward, the inside turn of the paper is pulled out slightly so that it can be grasped for removal after which the roll of paper is placed with other similar rolls and is packaged for distribution.

Accordingly, the invention may be summarized as a two piece heated tube long enough to receive substantially the entire length of the core of a roll of paper and having a smooth tapered tip so that the glue holding the cardboard core to the roll of paper is softened by heating the tube after which the core is removed.

DETAILED DESCRIPTION

Although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention, which is defined by the claims.

Figure 1:
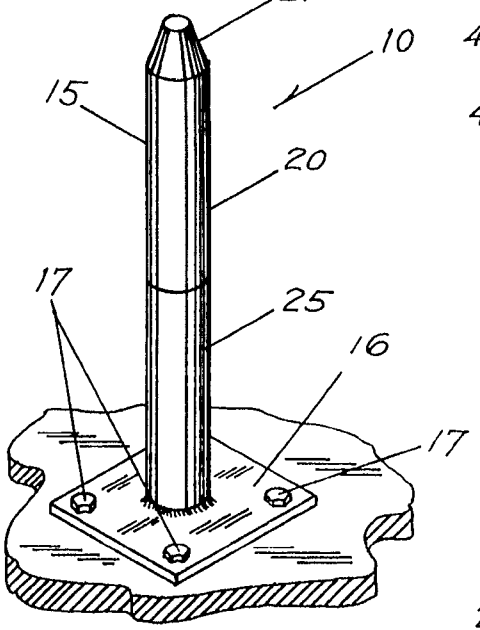
FIG. 1 is a perspective view of the core remover.

Referring to FIG. 1, the core remover 10 may be seen. Core remover 10 comprise a tube 15, a base 16, heating element 30, and temperature sensor 40. Tube 15 has top part 20 and bottom part 25. Top part 20 has a tapered smooth tip 21 for ease in placement into an opening 51 of a core 50 and paper roll 52 onto core remover 10. Tube 15 is preferably made from aluminum, but other heat conducting substances may be used. The removable top part 20 of tube 15 facilitates easy inspection, maintenance, or replacement of heating element 30 or thermostat 40.

Figure 3:
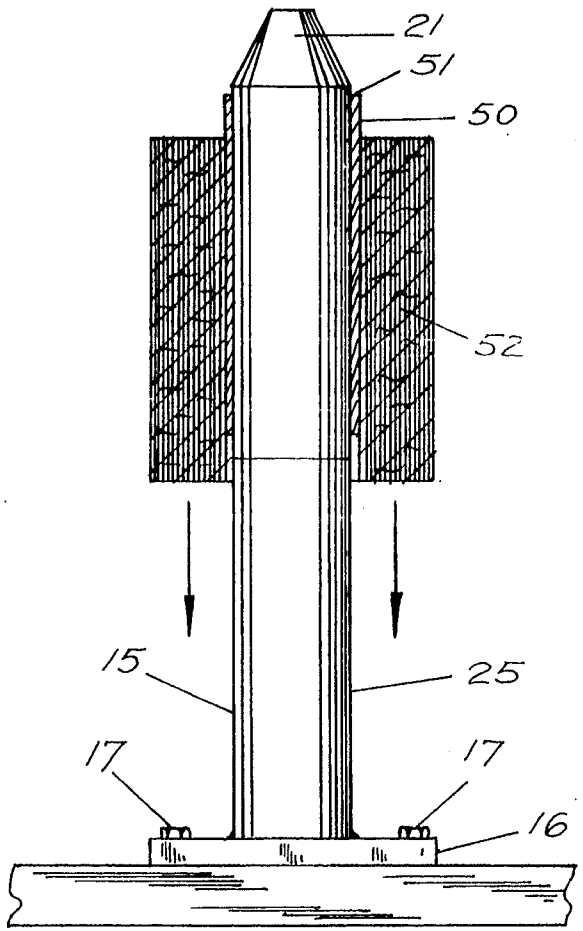
FIG. 3 is a front view thereof with a cutaway view of a roll of paper.
Figure 2:
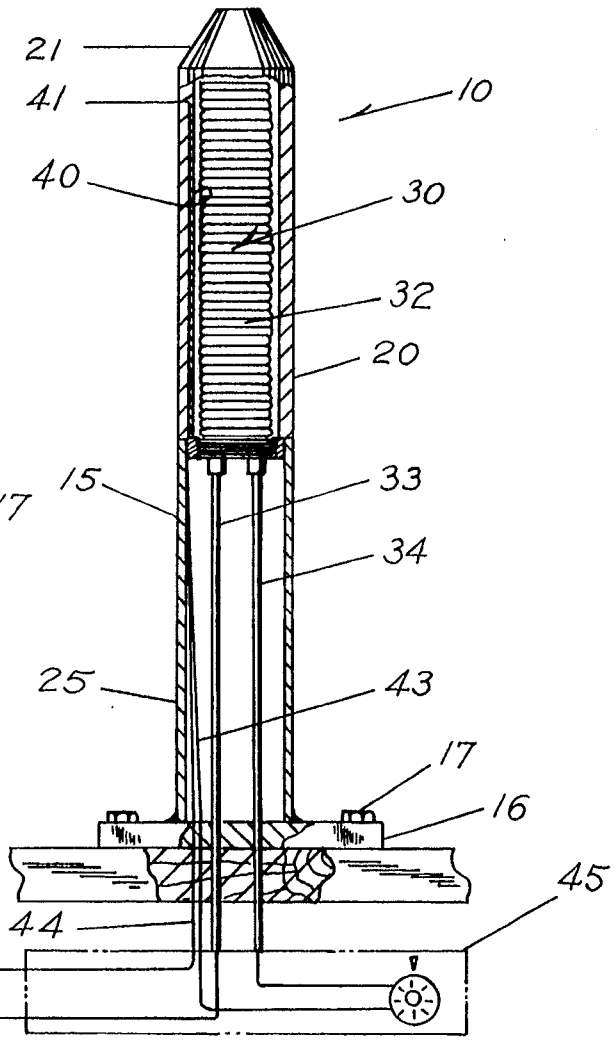
FIG. 2 is a front sectional view thereof.

Referring to FIG. 2, heating element 30 and temperature sensor 40 may be seen inside tube 15. Heating element 30 is preferably a 120 V, §inch diameter, low density cartridge heater, and is placed so that its heating portion 32 is in the top part 20 of tube 15. Connection leads 33 and 34 extend downward through bottom part 25 and base 16.

Temperature sensor 40 is preferably a bulb temperature sensor with temperature response from 200°-500° F. (93.3°-360° C.). The thermostat bulb 40 is placed in top part 20 of tube 15 at a location where temperature sensor 40 can sense the temperature of tube 15. Temperature sensor 40 is connected to heating element 30 and to power by leads 43 and 44. Temperature sensor 40 has its thermostat box 45 located at a convenient location for viewing and adjusting thermostat readings and settings.

The core remover 10 works as follows: The heating element 30 is heated. This in turn heats the tube 15 to a temperature, monitored by temperature sensor 40, which will loosen the glue that connects core 50 to paper roll 52 wrapped around it. Core 50 with paper roll 52 wrapped around it are slid onto tube 15 so that the tube 15 extends through opening 51. Core 50 is heated by tube 15. Placement of core 50 and paper roll 52 wrapped around it onto core remover 10 is made simple by the tapered tip 21 of top part 20 of tube 15. When core 50 has been heated sufficiently to loosen the glue connecting core 50 and the inner most part of paper roll 52, normally just a few seconds, core 50 is manually removed from paper roll 52. At the same time or after core 50 is removed from paper roll 52, the innermost sheet 54 of paper roll 52 is manually located and pulled up about 2 inches from the center 56 of the roll. Decored paper rolls 52 are then loaded into a dispenser cartoner for final packaging.

Alternatively, the tube 15 may be inserted into the opening 51 of the core 50 and the heating element 30 is then activated so that the core 50 is heated and the glue 16 loosened.

The above described embodiments of this invention are merely descriptive of its principles and are not to be limited. The scope of this invention instead shall be determined from the scope of the following claims, including their equivalents.

What is claimed is:

1. A core remover for removing cores from paper rolls, the core remover comprising:

a tube having a predetermined length sufficient to extend the entire length of a paper core;

said tube having a smooth tappered tip and containing a heating element;

a temperature sensor connected to and regulating the temperature of the heating element.

2. The core remover of claim 1 further comprising a thermostat control box for controlling the heating element.

3. A core remover for removing cores from paper rolls, the core remover comprising:

a tube having a bottom part mounted to a base and a removable top part having a tappered tip;

a cartridge heating element located inside said removable top part of the tube; and a temperature sensor located inside the tube and connected to the heating element and controlling the temperature of the heating element.

4. The core remover of claim 3 further comprising a thermostat control box for controlling the heating element.

5. A method for removing cores from paper rolls, the method comprising the steps of:

placing a core having a paper roll wrapped around it over a heated tube;

heating the core; and removing the core from the paper roll.

6. The method of claim 5 further comprising the step of pulling up the inner most sheet of paper from the paper roll.

7. The method of claim 5 wherein the heated tube comprises:

a tube having a predetermined length sufficient to extend the entire length of a paper core;

the tube having a smooth tappered tip and containing a heating element; and a temperature sensor connected to and regulating the temperature of the heating element.

8. A method for removing cores from paper rolls, the method comprising the steps of:

placing a core having a paper roll wrapped around it over a heated tube;

heating the core;

removing the core from the heated tube; and removing the core from the roll of paper.

9. A method for removing cores from paper rolls, the method comprising the steps of:

placing a core having a paper roll wrapped around it over a tube heater;

heating the tube heater; and removing the core from the paper roll.

* * * * *

UNITED STATES PATENT AND TRADEMARK OFFICE

CERTIFICATE OF CORRECTION

PATENT NO. : 5,389,763
DATED : February 14, 1995
INVENTOR(S) : Dennis Nagan, et. al.

It is certified that error appears in the above-indentified patent and that said Letters Patent is hereby corrected as shown below:

Title page, item [73], in the name of assignee after "Green" and before ",", insert --Bay--.

Signed and Sealed this

First Day of August, 1995

*Attest:*

*Attesting Officer*

BRUCE LEHMAN

*Commissioner of Patents and Trademarks*